United States Patent [19]

Wiley

[11] Patent Number: 4,837,870

[45] Date of Patent: Jun. 13, 1989

[54] SPA OVERFLOW SYSTEM

[76] Inventor: Robert B. Wiley, 4655 118th Ave., Clearwater, Fla. 33520

[21] Appl. No.: 59,574

[22] Filed: Jun. 8, 1987

Related U.S. Application Data

[63] Continuation of Ser. No. 712,531, Mar. 18, 1985, abandoned.

[51] Int. Cl.[4] ..... E04H 3/18

[52] U.S. Cl. ..... 4/508; 4/542

[58] Field of Search ..... 4/538, 541–544, 4/507–510, 584

[56] References Cited

U.S. PATENT DOCUMENTS

| | | | |
|---|---|---|---|
| 2,073,784 | 3/1937 | Day | 4/509 X |
| 2,739,939 | 3/1956 | Leslie | 4/509 X |
| 3,306,448 | 2/1967 | Baker | 4/509 X |
| 3,537,111 | 11/1970 | Whitten | 4/508 |
| 3,739,405 | 6/1973 | Schmidt | 4/508 |
| 4,233,694 | 11/1980 | Janosko et al. | 4/509 X |
| 4,530,120 | 7/1985 | Etani | 4/538 |

*Primary Examiner*—Charles E. Phillips

*Attorney, Agent, or Firm*—Walter J. Monacelli

[57] ABSTRACT

A spa of the commercial variety improved by having a flow control system associated therewith that includes overflow chambers and tank capable of retaining or storing water displaced from the spa during the entry into the spa of one or more individuals in the use thereof. The overflow water, in being received in the overflow chamber and tank, does not spill over the top of the spa but is available or continued use in the spa through the return thereof to the spa by venturi nozzle means included in the normal water flow circulation means provided for the spa wherein water is drawn from the spa and passed through a filter for the cleaning thereof by a pump which then delivers the pumped and cleaned water to the spa through the venturi nozzle, with the outlet of the nozzle disposed adjacent the return delivery point of the water from the overflow chamber and tanks.

5 Claims, 1 Drawing Sheet

FIG. 1
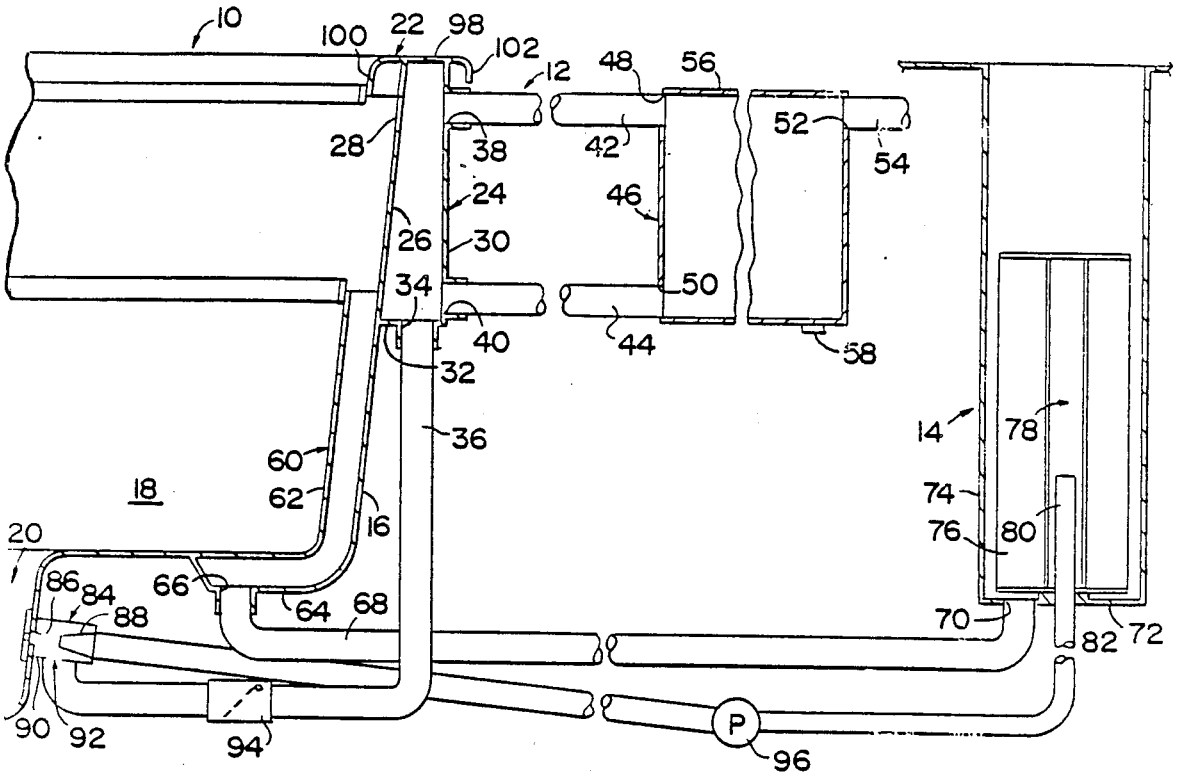
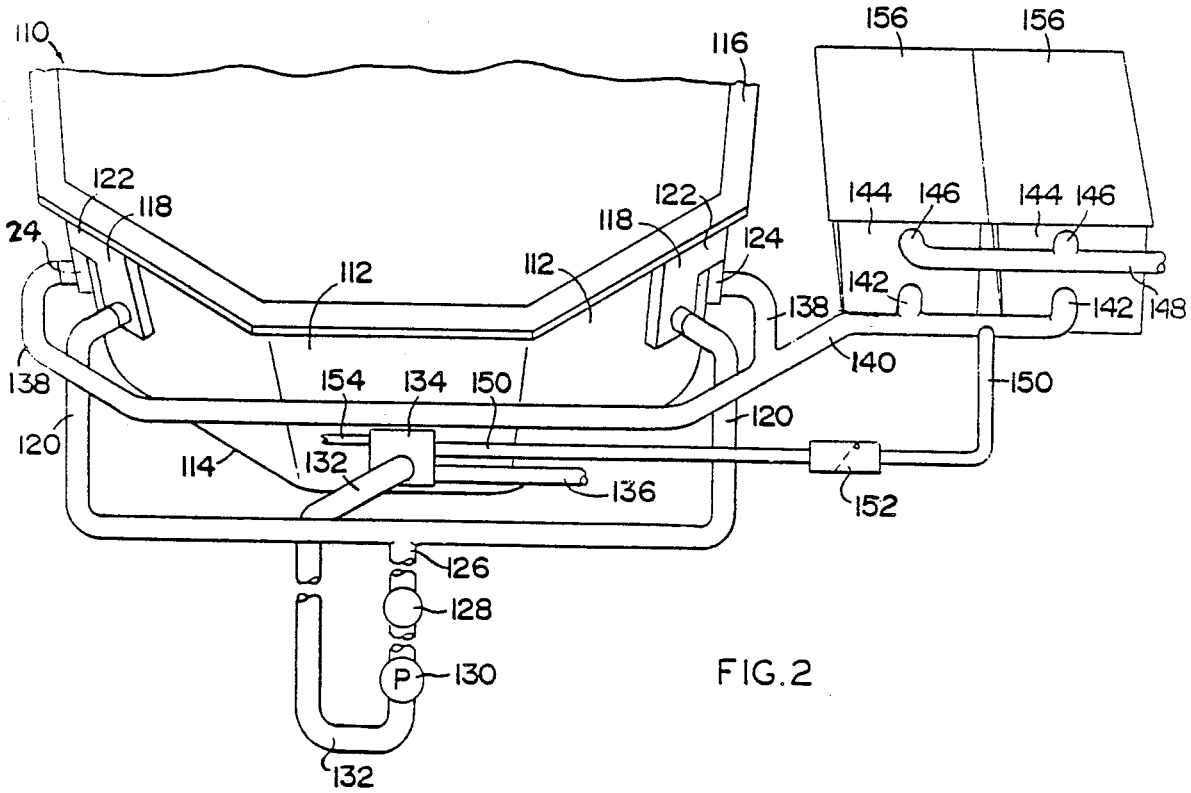
FIG. 2

SPA OVERFLOW SYSTEM

This is a continuaton of pending application Ser. No. 712,531, filed Mar. 18, 1985, now abandoned.

BACKGROUND OF THE INVNETION

1. Field of the Invention

This invention relates to spas or tubs and more particularly to commercial spas having an overflow control system.

2. State of the Prior Art

U.S. Pat. Nos. 3,391,790, 3,739,405, 4,092,746 and 4,373,220 are representative of art relating to water level maintenance in swimming pools, but as such do not meet the criteria of the present invention in the overflow control of a spa.

SUMMARY OF THE INVENTION

The structure coverd hereby is the provision of a commercial spa or tub with a novel overflow control system. In view of the size of a commercial spa which is adapted to be used by many individuals at the same time and the great amount of water to be displaced in a short time as the individuals enter the spa, it is essentially important to provide for the effective holding or retention of said displaced water. As such the instant invention comprises a spa and an overflow system wherein as the water in the spa is displaced upon entry thereinto by an individual, the level of the spa is maintained with the overflow water flowing through overflow port of the spa into an overflow chamber immediately adjacent the spa. The chamber is relatively narrow in width but extends vertically a reasonable distance along the side of the spa. Water conduits connected at the bottom and the top to the chamber in communication therewith, extend horizontally away from the chamber and spa. The opposite ends of the conduits are connected to an auxliary overflow tank and as such, provide water flow communication between the chamber and tank. Whereas the one conduit is connected to the bottom of the chamber and bottom of the tank, the other conduit has its lowest horizontal flow point which is positioned vertically above the rim of the spa. As such, water overflow from the spa initially flows into the chamber and by way of the lower conduit, into the bottom of the tank. This represents the normal flow of overflow water into the chamber and auxiliary tank. If several individuals enter the spa at the same time the large instant displacement of water is accommodated by the flow of surge water through the upper conduit to the upper portions of the same, and at the same time water is passing through the chamber and lower conduit to the bottom of the auxiliary tank. So as to provide for the flow of water from the chamber and auxiliary tank for return to the spa, a conduit communicating with the bottom of the chamber extends vertically downward to a point near the bottom water level of the spa and then extend horizontally to a point of communicating entry near the bottom of the spa. A header is provided at the connecting point of the conduit with the spa in which is disposed a venturi nozzle which is in turn connected to a conduit having a water pump associated therewith. The conduit with the pump therein is connected to the outlet of a filter system for the spa. Within the spa along the inner side thereof is a skimmr chamber having an inlet in the spa disposed below the overflow rim of the spa, with the skimmer chamber having communication connection through a conduit with the bottom of the filter system.

With the pump in operation and the water being drawn from the spa through the skimmer chamber, the water is drawn through the filter provided in the filter system and discharged through the pump conduit and venturi nozzle to the spa. As the water flows through the venturi, a suction is created effective to simultaneously draw water from the overflow chamber and auxiliary tank through the outlet conduit thereof. So as to prevent back flow in the outlet conduit of the overflow chamber, a one-way check valve is disposed therein.

BRIEF DESCRIPTION OF THE DRAWINGS

FIG. 1 is a vertical cross-section of the spa, overflow structure and filter; and FIG. 2 is a partially broken-away perspective view of an alternate form of spa.

DESCRIPTION OF THE PREFERRED EMBODIMENT OF THE INVENTION

In FIG. 1, spa 10 has associated therewith an overflow structure 12 and a filter structure 14. Spa 10 includes stepped peripheral wall 16 provided with upper and lower water holding portions 18 and 20 respectively, and an upper peripheral rim section 22. An overflow chamber structure 24 is arranged adjacent the spa with the upper portion 26 of wall 16 on its outer side of the spa constituting a wall of chamber structure 24. Chamber structure 24 communicates with the spa through an opening or port 28 in portion 26 of wall 16 adjacent rim section 22. Wall 30 of chamber structure 24 spaced from portion 26 of wall 20 comprises the outer wall of the chamber structure. The base 32 of chamber structure 24 has an opening 34 therein in communication with a pipe or conduit 36 attached to base 32. Vertically spaced openings 38 and 40 in outer wall 30 are each connected to respective pipes or conduits 42 and 44. Conduits 38 and 40 extend horizontally and parallel to each other for appropriate communication with an auxiliary overflow tank 46 through upper and lower spaced openings 48 and 50 respectively. An opening 52 in tank 46 opposite opening 48 has an overflow conduit 54 connected thereto. The top 56 of auxiliary tank 46 is appropriately removable so as to effect cleaning of the tank and a drain plug 58 is arranged in the base of the tank for draining water therefrom.

Spa 10 has disposed along wall 16 upper portion 26 a skimmer chamber structure 60 including an inner wall 62 which together with portion 26 of wall 16 at the base thereof, provide a manifold 64. An opening 66 in the manifold communicates with a conduit 68 attached to the manifold. The conduit extends horizontally for communication through an opening 70 provided in the base 72 of filter housing 74 of filter structure 14. Filter housing 74 is cylindrical in shape and has disposed centrally thereof a filter 76. The housing has a vertical height approximately equal to the highest upper most portion of the spa so as to accommodate the water level of the spa therein. The filter and filter housing provide for the water flowing in the housing to pass through the filter for the cleaning thereof. Centrally disposed in central tubular space 78 is an open ended tube or pipe 80 which extends in sealed relation through an opening 82 provided centrally of housing 74 through base 72 thereof.

Pipe 80 extends from housing 74 to connect with a manifold 84 arranged near the lower port 30 of the spa and communicating with the spa through an opening 86 therein. Pipe 80 as arranged on manifold 84 terminates in a venturi nozzle 88 in communication centrally of the manifold. Base 9 of the manifold has an opening 92 therein and is connected in communication therewith to the opposite end of conduit 36 from its connection with the base of chamber structure 24. A one-way check valve 94 is arranged in conduit 36 permitting flow of water from overflow chamber structure 24 to manifold 84 but effective to inhibit reverse flow of water. A pump 96 is arranged in pipe 80 effective to provide for the flow of water from the skimmr chamber of the spa through the filter for return to the spa by way of manifold 84.

Although only one overflow port 28 is disclosed it is understood that any suitable number can be circumferentially spaced in wall 26 having communication with overflow chamber structure provided extending circumferentially around the spa so that displaced water exiting ports 28 will flow directly into the overflow chamber.

DESCRIPTION OF AN ALTERNATE EMBODIMENT OF THE INVENTION

FIG. 2 discloses a somewhat simplified version of spa 10 and the overflow control system therefor. A spa 110 of octagonal shape includes sidewalls 112, a bottom 114 and a rim 116.

Header or manifolds 118, having water communication with the inside of the spa and with conduits 120 connected externally thereto, comprise skimmer chambers for the spa. Manifolds 118 are preferably molded of resin impregnated figerglass and also have communication from portion 122 thereof with overflow chamber headers 124 mounted adjacent manifolds 118. Conduits 120 provide for flow of water from manifolds 118 to a common conduit 126 which has disposed therein a filter 128 and a pump 130. The pressure side of the pump discharge through conduit 132 to a manifold 134 having jet water supply communication with the spa. Manifold 134 in the lower portion thereof has conduit 136 connected thereto for delivering return water to other jet outlets arranged suitably about the spa, preferably near the lower portion thereof. Conduit 132 as arranged in manifold 134 includes a venturi nozzle, not shown, the purpose of which will hereinafter appear.

Overflow chamber headers 124 are connected by conduits 138 to a conduit 140 having branches 142 thereof connected to the lower portion of side by side overflow tanks 144 into which overflow water from the spa can be stored or retained, depending on the spa occupancy during the use thereof. The tanks each have arranged near the top thereof an overflow conduit 146 connected to an overflow conduit 148, adapted in turn to provide water flow to an appropriate water or drain system.

A conduit 150 of smaller diameter and flow capacity to all the other conduits provided is connected intermediate branches 142 for the return delivery of water from the tanks to the spa by reason of its communication connection at its opposite end with manifold 134. A one-way check valve 152 is arranged in conduit 150 permitting water flow from the tanks to manifold 134 but preventing reverse flow therein. Jet air is supplied by a line 154 to manifold 134 effective with the water flow from conduit 150 and venturi nozzle of conduit 132 to provide for jet air-water delivery to the spa.

Suitable covers 156 are provided for the tanks so as to permit ease in the cleaning thereof and a drain plug, not shown, is also provided for each tank. The tanks should preferably have the tops of a few inches below the top of spa and its lower drain point of conduit branches 142 below the intake level of conduit 138 connection with headers 124.

OPERATIONAL USE OF THE SYSTEM

In a normal unoccupied state of the spa 10, the water therein would be maintained at a level corresponding to the lower edge of port 28 with or without the pump 96 in operation. With the pump in operation and with spa as yet unoccupied, water would flow through the skimmer chamber 60, manifold 64 and conduit 68 to filter housing 74 and through filter 76 for subsequent flow through tube 80 communicating at its opposite end to the intake side of pump 96. Water inflowing to pump 96 is discharged therefrom for flow through venturi nozzle 88, manifold 84 and opening 36 into the lower portion 20 of the spa. A continual operation of the pump provides for a continuous flow of water from the spa and return to the spa providing for the effective filtering thereof.

At such time as the spa becomes occupied, water equivalent to the body volume will be displaced and immediately be discharged through port or ports 28 and empty into overflow chamber 24. A small volume of water displaced into chamber 24 will initially flow through conduit 44 to auxiliary overflow tank 46 and fill only a small portion of the provided capacity of chamber 24 and tank 46. As a great number of bodies enter the spa, a greater displacement of water through port or ports 28 along with water surges through the ports will move water through conduit 42 into the upper portion of tank 46. Water simultaneously continues to flow from chamber 24 through conduit 44 to tank 46. It is to be noted that the lower most position of conduit 42 is at a point above the lower point of port 28 so that the normal flow of water fills the overflow chamber before the flow of water through conduit 42 to the tank.

Water entering the overflow chamber is free to move therefrom through conduit 36 into manifold 84. At this point the action of venturi nozzle 88 is effective to suck or draw water from conduit 36 for flow with water from the filter and pump to the spa. As this action is occurring the level of the water in the spa is relatively constant aside from movement of the bodies in the spa causing slight overflow through port 28. Simultaneously herewith the water equating the volume of water displaced by the bodies is retained in the overflow chamber and auxiliary tank. As one or more bodies leave the spa, a volume of water equivalent thereto is returned to the spa to fill the spa.

Although not shown, air can be suitably supplied to manifold 88 effective to provide for jet air-water delivery to the spa.

In the use of spa 110 and without occupants, the water in the spa flows therefrom, in the normal operation of pump 130 through the skimmer chambers of manifolds 118 through conduits 102, conduit 126, filter 128, and pump for return delivery to the spa by conduit 132 through manifold 134 and a venturi nozzle, now shown, arranged on the end of conduit 132. During the flow through the skimmer chamber debris on the surface of the water is skimmed and delivered for water cleaning through the filter.

At such time that water is displaced by the entry of bodies in the spa, the overflow passes from manifold 118 to overflow headers 124 for delivery by conduits 138 to a conduit 140 and branches to overflow tanks 144. Simultaneously, a smaller flow of water than is carried by all other conduits of the system flows from conduit 150 to manifold 134. The venturi nozzle, not shown, in manifold 134 is effective to draw the water through conduit 150 for return to the spa. During the operation of the overflow system, pressure air supplied to the upper portion manifold 134 and together with the water delivered hereto aerates the jet water supplied to the spa. Whereas only one conduit 150 is provided for supplying overflow water for return to the tank, any suitable number of manifolds 134 can be provided for the connection to conduits 136 and delivery of jet air-water to the spa.

As the volume of water in the spa is changed due to the number of bodies entering or leaving the spa, the overflow tanks will fill and drain in accordance therewith to maintain the water at its desired level near the top rim of the pool.

Although specifics of construction are illustrated and defined, variations in structure are conceivable within the scope of the aforesaid description and accordingly, the appended claims are intended to clarify same.

My invention is thus claimed as follows.

What is claimed is:

1. A spa having (a) a water overflow control system and (b) a water flow circulating system connected thereto, with the overflow control system comprising an overflow chamber having an upper end and a water overflow tank communicating with the chamber, with the chamber communicating at said upper portion with the spa at its normal desired upper water level, (c) a manifold communicating with the spa at a point in the lower portion of the spa; and (d) a conduit communicating at one end with the bottom of the overflow tank and at its other end with the manifold, and with the circulation system comprising a second conduit communicating at one end with the overflow chamber and with the manifold at its other end and terminating in a venturi nozzle disposed adjacent the discharge end of the first conduit such that the venturi action is induced on the overflow tank by way of the first conduit, and having a pump arranged intermediate the ends of the second conduit for pumping water from the upper portion of the spa to the manifold.

2. A spa according to claim 1, wherein the inlet end of the second conduit operates as a debris skimmer flow point and the inlet end of the first conduit is connected to a header having communication adjacent the skimmer inlet of the second conduit.

3. A spa according to claim 1, wherein a water filter is arrangd in the second conduit upstream from the pump, and a skimmer chamber arranged at the inlet end of the second conduit.

4. A spa according to claim 3, wherein the overflow tank communicates with the overflow chamber at point vertically below the level of the chambers communicating with the header therefor and the top of the tank is disposed below the upper normal water level of the spa.

5. A spa having (a) a water overflow control system and (b) a water flow circulating system connected thereto, with the overflow control system comprising an overlfow chamber and a water overflow tank communicating with the chamber, with the chamber communicating at its upper portion with the spa at its normal desired upper water level (c) a manifold communicating with the spa at a point in the lower portion of the spa, and (d) first conduit communicating at one end with the bottom of the overlflow tank and at its other end with the manifold, and with the circulation system including a second conduit communicating at one end in the upper portion of the spa and with the manifold at its other end, and having a pump arranged intermediate the ends of the second conduit for pumping water from the upper portion of the spa to the manifold said pump via venturi action in said manifold being effective to draw water through the first conduit for flow from the overflow tank to the bottom of the spa by way of the manifold.

* * * * *